US005772190A

United States Patent [19]

May et al.

[11] Patent Number: 5,772,190

[45] Date of Patent: Jun. 30, 1998

[54] SPRING MEMBER

[75] Inventors: Michael M. May, Stillwater; Gregory S. Mitsch, Woodbury; Nidelkoff John Michael, St. Paul, all of Minn.; Les L. Pallin, Prescott, Wis.

[73] Assignee: Intek Weatherseal Products, Inc., Hastings, Minn.

[21] Appl. No.: 739,063

[22] Filed: Oct. 28, 1996

Related U.S. Application Data

[63] Continuation of Ser. No. 591,957, Jan. 23, 1996, abandoned, which is a continuation of Ser. No. 141,114, Oct. 20, 1993, abandoned, which is a division of Ser. No. 811,083, Dec. 20, 1991, Pat. No. 5,265,308, which is a continuation-in-part of Ser. No. 630,311, Dec. 19, 1990, abandoned.

[51] Int. Cl.[6] ..... E05D 13/00; E05D 15/16

[52] U.S. Cl. ..... 267/141; 16/197; 49/419; 267/158

[58] Field of Search ..... 248/566, 621, 248/632, 634; 267/36.1, 136, 141, 158, 164, 165, 260, 292, 140.3, 160, 163; 16/197, 199; 49/414, 419

[56] References Cited

U.S. PATENT DOCUMENTS

| | | | |
|---|---|---|---|
| 2,647,717 | 8/1953 | Norris et al. | 267/141 |
| 2,660,424 | 11/1953 | Nallinger | 267/30 |
| 2,927,171 | 3/1960 | Rhodes | 267/163 X |
| 3,145,433 | 8/1964 | Jones | 49/419 X |
| 4,001,366 | 1/1977 | Brumlik | 264/147 |
| 4,034,510 | 7/1977 | Huelsekopf | 49/419 |
| 4,405,848 | 9/1983 | Jaegle | 267/158 X |
| 4,411,159 | 10/1983 | Spear et al. | 267/158 X |
| 4,419,315 | 12/1983 | Kessler | 264/145 |
| 4,420,141 | 12/1983 | Goloff | 267/158 X |
| 4,666,196 | 5/1987 | McCoy et al. | 267/141 X |
| 4,934,724 | 6/1990 | Allsop et al. | 267/30 X |
| 5,209,518 | 5/1993 | Heckenliable et al. | 267/36.1 X |
| 5,265,308 | 11/1993 | May et al. | 16/197 |
| 5,375,376 | 12/1994 | Scott | 49/419 X |
| 5,443,247 | 8/1995 | Polites et al. | 267/160 X |
| 5,526,608 | 6/1996 | Stark | 49/419 |

FOREIGN PATENT DOCUMENTS

| | | | |
|---|---|---|---|
| 241536 | 11/1985 | Japan | 267/160 |

*Primary Examiner*—Josie Ballato

*Attorney, Agent, or Firm*—Merchant, Gould, Smith, Edell, Welter & Schmidt, P.A.

[57] ABSTRACT

A coextruded plastic spring member is disclosed which is bendably disposable between first and second member to create a spring force therebetween. The spring member includes an elongated base formed from a first plastic material which is engageable by the first member. An elongated first spring portion formed from a second plastic material that is resilient and has a predetermined spring characteristic is coextruded with the base member. An elongated second spring portion is coextruded with and extends from the first spring portion and is formed from a third plastic material having a spring characteristic stiffer than that of the first spring portion, with the second spring portion being engageable by the second member. The first and second spring portions are constructed so that the first spring portion is under compressive loading when the second spring portion is bendably engaged by the second member.

26 Claims, 4 Drawing Sheets

SPRING MEMBER

REFERENCE TO RELATED APPLICATIONS

This is a continuation of application Ser. No. 08/591,957, filed Jan. 23, 1996, now abandoned which is a continuation of application Ser. No. 08/141,114, filed Oct. 20, 1993, now abandoned which application is a division of application Ser. No. 811,083 filed Dec. 20, 1991, now U.S. Pat. No. 5,265,308, which is a continuation-in-part of application Ser. No. 630,311 filed Dec. 19, 1990, now abandoned. The disclosure of application Ser. No. 630,311 is hereby incorporated by reference into this application.

BACKGROUND OF THE INVENTION

The invention broadly relates to jamb liners for window assemblies, and is specifically directed to a jamb liner usable for slidable closures such as double hung windows and including structure for biasing the jamb liner against the closure member.

The conventional construction of double hung window assemblies includes a jamb liner that is mounted to each side of the jamb to receive and guide the slidable window or sash. Typical jamb liners are extruded from thermoplastic materials such as polyvinylchloride, and are configured with a profile that mates with the sides of the sash for optimum guided sliding movement. Double hung windows are suspended from various types of spring mechanisms that are usually incorporated into the jamb liner. It is also conventional to include some type of spring bias between each jamb liner and its associated jamb to urge both jamb liners into frictional engagement with the sides of the sash, which permits the sashes to be maintained in a desired position. This spring function has been accomplished through various types of spring means, ranging from metal leaf springs to a thickness of resilient polyurethane foam.

These conventional approaches have encountered problems over a period of time insofar that the spring function is concerned. For example, polyurethane foam, which is frequently used in window construction, tends to degrade and become hardened over time due to exposure to air and ultraviolet light. In addition, this approach requires an additional component in the window assembly and therefore increases the cost not only from the standpoint of manufacture but in assembly and installation as well.

Another significant disadvantage is the inability of conventional spring devices to act as a seal against air and moisture. In other words, although the window itself provides such a seal to the primary window opening, it is nevertheless possible for air and moisture to pass through the peripheral space between the jamb liner and jamb. The problem of air and moisture leakage also exists where a backing of resilient foam has been used due to its open cellular structure, although to a lesser extent than conventional spring devices.

A further problem encountered with conventional spring devices, including resilient foam backing, is the inherent linear relationship between deflection and force; i.e., the more the jamb liner is depressed, the greater the resistive force it imparts to the associated sash. Accordingly, if variations occur in the construction, the result can be a sash that slides too easily or with too much difficulty. It is also possible for variations to occur in this biasing force as a function of temperature.

The inventive jamb liner is the result of an endeavor to provide a spring function in a jamb liner that is simpler and potentially less expensive to manufacture and install, and which also provides an effective seal against moisture and air. Specifically, the invention comprises an extruded jamb liner that is provided with at least one longitudinal spring hinge member that projects from the rear or inner face of the jamb liner for engagement with the associated jamb side. Although other manufacturing approaches are possible, the preferred embodiment includes two continuous, elongated spring hinge members that are integrally formed with the jamb liner itself by coextrusion. The hinge member consists of an elongated strip of material the inner or contiguous portion of which is extruded from a resilient, spring like material from a family of thermoplastic elastomers, such as polyurethane or polyester, or blends of such materials, with the extremity of the strip coextruded from the same material as the jamb liner (e.g., relatively stiffer polyvinylchloride). Through coextrusion, the resilient and stiffer portions are simultaneously and integrally formed with the jamb liner into a single unit that simplifies both manufacture and installation. The hinge member, which is flat and blade-like in the first embodiment, is angularly disposed relative to the rear face of the jamb liner, enabling it to be bendably compressed over its length about the resilient portion upon engagement with the associated jamb side. The engagement extends over the entire length of the jamb liner, thus providing both the spring function and a seal against moisture and air.

In the first embodiment, the hinged, flat spring members are disposed identically at the same angle, which facilitates entry of the window assembly into the jamb from one direction (typically from the inside of the window opening). In a second embodiment, the spring hinge members are predominantly flat with curved extremities, and are symmetrically and angularly disposed along the outer edges of the jamb liner.

A third embodiment employs the same structural concept of coextruding resilient and relatively rigid portions to create flexible longitudinal hinge members. However, whereas the first and second embodiments flex in such a manner as to create tensile forces that may become excessive within the resilient portion, the third embodiment is constructed so that flexure results primarily in compressive forces. It has been found that such a configuration resists the incidence of creep (i.e., compression set and lost resilience) in the resilient portion over periods of long use over a wide variety of temperatures. Since creep can result in the loss of resilience, this can adversely affect not only the ability of the jamb liner to properly bias the associated sash, but also the function of sealing against moisture and air.

The third embodiment has a longitudinal hinge member including a resilient portion formed into a small hollow tube or envelope. The hinge member also includes a relatively rigid portion which is predominantly flat, although it may include structural variations along its outer edge to accomplish the desired function in engaging the associated window jamb. It is possible for the hinge member to function satisfactorily with only the resilient tube, but the preferred form includes the relatively rigid flat portion for engaging the window jamb.

It has been found through experimentation with various configurations of the resilient portion that the small enclosed tube or envelope produces a strong, uniform spring force over its length, even under greater and lesser deflections, and also one which remains relatively constant without any significant degree of creep over significant periods of time.

In all embodiments, the coextrusion of the spring hinge members results in a structure that is extremely simple, less expensive to manufacture than the assembly with separate springs, easier to install and long lasting. In addition, the spring hinge members provide an effective and continuous seal against moisture and air over the entire length of the jamb liner, and where two spring hinge members are used, the sealing capability is doubled in addition to providing a uniform spring bias against the sash. Further, all of the embodiments of the improved spring hinge members produce a force upon flexure that is substantially constant over the range of deflection as well as a broad range of temperatures. Consequently, the force imposed by the jamb liners on the associated sashes is essentially constant even with dimensional variations as well as temperature changes. This advantageously permits design of the components to achieve a desired force for optimum sash sliding operation.

The invention is shown embodied in a jamb liner for a double hung window that is not capable of being tilted, but it may be easily adapted to tilt-out windows. The invention may also be adapted for use in a liner that guides a horizontally slidable window or sash, and is not limited to vertically slidable closures.

Further features and advantages will be appreciated from the accompanying specification and drawings.

DETAILED DESCRIPTION OF THE PREFERRED EMBODIMENT

Figure 1:
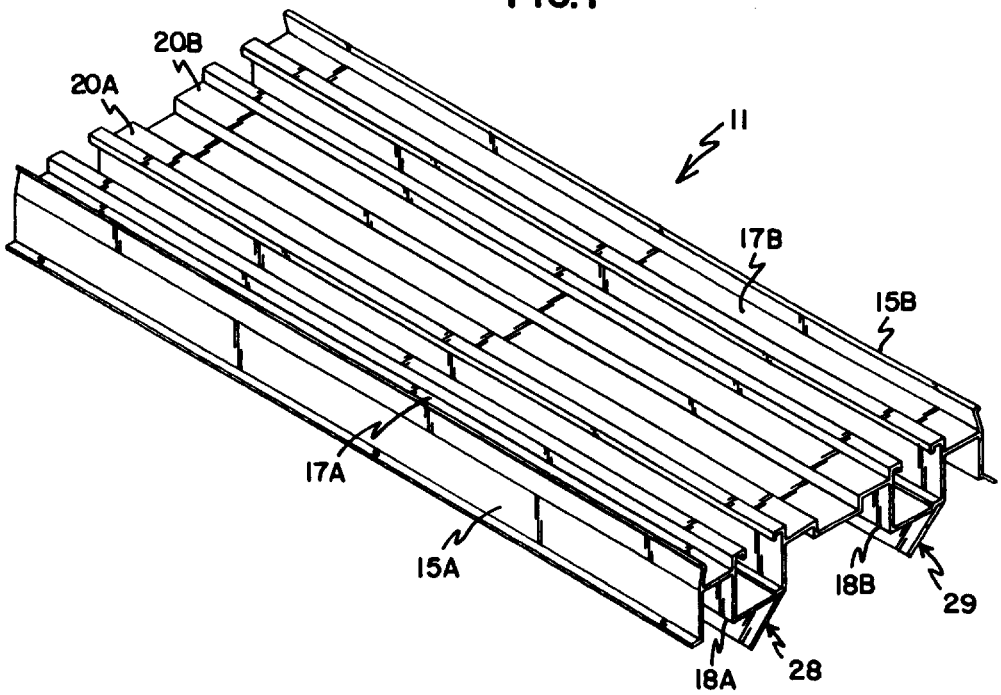
FIG. 1 is a perspective view of a first embodiment of a jamb liner embodying the invention.
Figure 2:
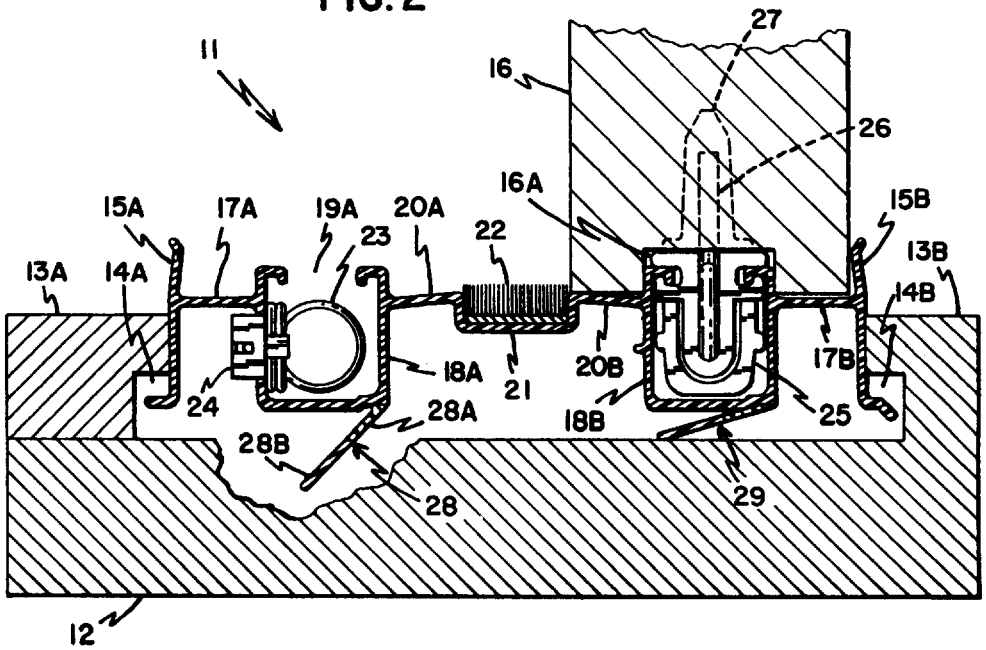
FIG. 2 is an enlarged transverse sectional view of the liner of FIG. 1.

With initial reference to FIGS. 1 and 2, a first embodiment of the inventive jamb liner is represented generally by the numeral 11. In the preferred embodiment, the main portion of jamb liner 11 is extruded from a thermoplastic material such as polyvinylchloride (PVC) that is at least semi-rigid. The rigidity of the jamb liner 11 depends not only on the material from which it is extruded, but its configuration and wall thickness as well. The typical wall thickness for the jamb liner 11 as shown is 0.045 inches.

Jamb liner 11 has a length and width chosen to correspond to the side of the window jamb with which it is used. The jamb liner typically fits into the associated jamb side and overlies it in part, as disclosed below.

For example, a typical jamb side is represented generally by the numeral 12 in the transverse section of FIG. 2, and is shown to define lateral abutments or stops 13A, 13B, and associated recesses 14A, 14B that engageably receive longitudinally extending edge members 15A, 15B of the liner 11. The stop 13A is removable to permit installation.

Jamb liner 11 is specifically intended for use with a double hung window, and is symmetrically configured to receive and guidably retain a pair of slidable windows or sashes 16, one of which is shown in FIG. 2. The construction of jamb liner 11 accordingly includes a web 17A that interconnects edge member 15A with a guide way member 18A having a square cross section with a front opening, longitudinally extending slot 19A. A second web member 20A of stepped configuration interconnects the guide way 18A with the opposite half of the jamb liner, which is symmetrically identical and bears similar reference numerals. The webs 20A, 205 define a shallow longitudinal recess 21 that may receive a short length of carpet-like material 22 that acts as a seal between the sashes 16.

With continued reference to FIG. 2, it will be seen that the front or outward face of the jamb liner 11 defines a profile that mateably receives and guides the sash side in sliding relation. More particularly, the sash side includes a longitudinal groove or recess 16A, and the forward portion of the guide ways 18A, 18B project into the groove 16A.

The guiding mechanism disposed in guide ways 18A, 18B is identical, although the mechanism shown in guide way 18A is viewed from the top of the assembly and the mechanism shown in guide way 18B is viewed at an intermediate point. More particularly, an elongated coil spring 23 in guide way 18A is suspended from the top of the guide way by a clip 24. As shown in the guide way 18B, a guide 25 is suspended from the lower end of the spring 23 and slides longitudinally therein. Guide 25 includes a metal pin 26 that projects laterally and is received in a plastic insert 27 that is press fit into the sash side near its bottom edge. As constructed, the sash 16 is suspended from the spring 23 from the guide 25 through the pin 26 and insert 27 to smoothly slide relative to the jamb liner 11.

Because the force generated by spring 23 varies as a function of its extension, it is necessary to incorporate a substantially constant frictional force between the sash 16 and the jamb liner 11 so that the sash 16 will remain where it is placed by the user. This frictional force is created by integrally forming a pair of spring hinge members 28, 29 on the rear face of the jamb liner 11. More particularly, each of the spring hinge members 28, 29 comprises an elongated flat strip of material that is integrally formed with the associated guide way 18A, 18B and extends over its length. Preferably, spring hinge members 28, 29 are coextruded with the entirety of the jamb liner 11.

As shown in FIG. 2, each of the spring hinge members 28, 29 is coextruded in two parts. The inner most part 28A (i.e., the part which is integrally formed and contiguous with the guide way 18A) is extruded from a resilient, spring-like plastic material such as thermoplastic polyurethane or other elastomeric material or blend of materials. The extremity of the spring hinge member, which bears reference number 28B, is extruded from a thermoplastic material that is at least semi-rigid, preferably from the same material as the main portion of jamb liner 11.

In its extruded state, hinge member 28 occupies the angular position shown in FIG. 2. However, and with i.e., at an acute angle relative to jamb liner 11 reference to spring hinge member 29, when the jamb liner 11 is installed, the spring hinge members are abuttably engaged and compressed into the more angular position shown with hinge member 29. Since each of the hinge members 28, 29 extends over the entirety of the length of jamb liner 11, each generates a biasing or spring force on the associated guide way 18A, 18B, that is in turn transmitted through the webs 17A, 17B, 20A, 20B and the guide members 25. The jamb liner on the opposite side of the sashes 16 generates the same force in opposition. As a result, each of the sashes 16 is frictionally compressed between the jamb liners 11 with uniform friction, and the sashes 16 may therefore be positioned and retained in any position within the window opening.

Because hinge members 28, 29 are extruded over the length of the guide ways 18A, 18B, their compression in the installed position generates spring forces that are distributed evenly over the side of each sash 16. The angular disposition of the spring hinge members 28, 29 facilitates mounting of the assembly within the associated jamb. More specifically, the two sashes 16 are initially assembled with the jamb liners 11 as a unit for insertion into the jamb opening from the inside of the window opening, and the angled spring hinge members 28, 29, oriented properly, permit simplified entry of the unit into the jamb opening.

Figure 3:
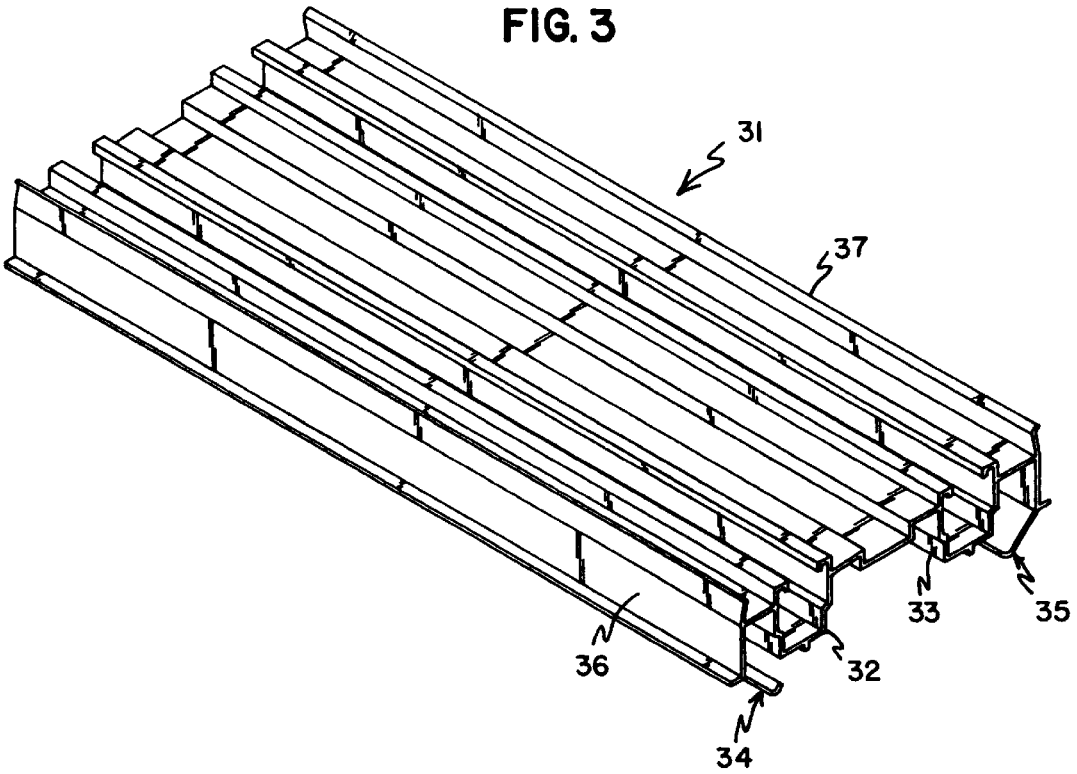
FIG. 3 is a perspective view of a second embodiment of the inventive jamb liner.
Figure 4:
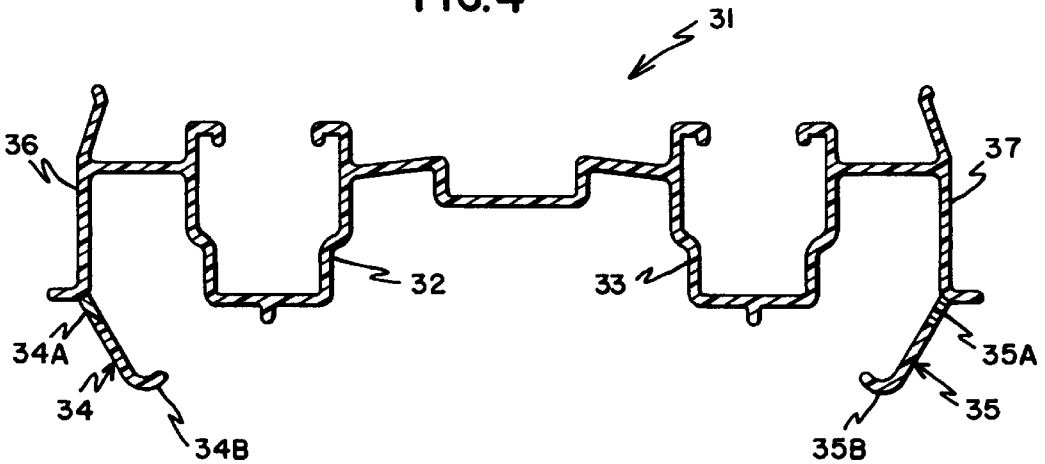
FIG. 4 is an enlarged transverse sectional view of the jamb liner of FIG. 3.

With reference to FIGS. 3 and 4, a second embodiment of the inventive jamb liner is represented generally by the numeral 31. Jamb liner 31 is structurally similar to jamb liner 11 with minor variations in the configuration of guide ways 32, 33. More particularly, jamb liner 31 includes spring hinge members 34, 35 that are configured as well as positioned differently than the spring hinge members 28, 29. As shown in FIG. 4, spring hinge member 34 is integrally formed (coextruded) with the edge member 36, projecting in an angular fashion both rearwardly and somewhat inwardly. Hinge member 34 includes a resilient inner portion 34A and a semi-rigid outer portion 34B that is curved inwardly at its extreme outward edge.

Similarly, spring hinge member 35 projects rearwardly and inwardly from edge member 37 and is of the same two-piece construction. The curved extreme edges of the outer portions 34B, 35B smoothly engage the surface of the associated jamb member, but compression of the hinge members must be effected by pushing the jamb liner 31 directly into the face of the associated jamb member.

Figure 5:
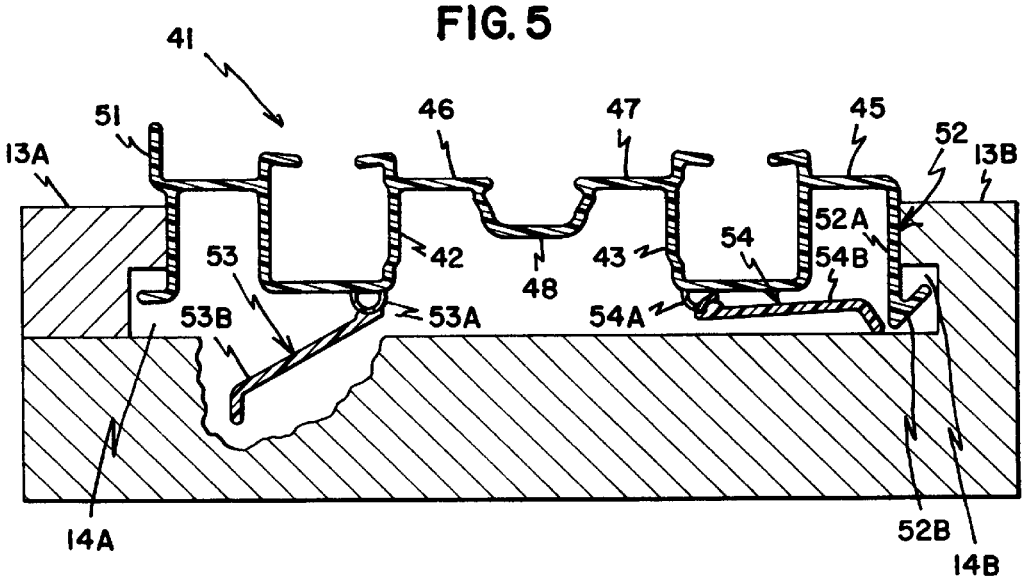
FIG. 5 is an enlarged transverse sectional view of a third embodiment of the inventive jamb liner.

With reference to FIG. 5, a third embodiment of the inventive jamb liner is represented generally by the numeral 41. Aside from the coextruded hinge members as described below, the construction of jamb liner 41 is quite similar to the jamb liners 21 and 31, including guide ways 42, 43, outer webs 44, 45, inner webs 46, 47 interconnected by a shallow receptacle 48 and edge members 51, 52. Edge member 51 is generally similar to edge members 15A and 36. Edge member 52 is structurally different in that it includes a straight leg 52A that engages the lateral abutment 13B (the reference numerals for the jamb 12 in FIG. 2 are retained in FIG. 5) and a barbed portion 52B that fits into the recess 14B. This construction permits the jamb liner 41 to be quickly installed by first inserting the edge member 51 into the recess 14A and then flexibly forcing the edge member 52 into the recess 14B, where it is retained by the barbed portion 52B. The jamb liner 41 can be removed by first removing the lateral abutment 13A.

The principal structural difference with jamb member 41 lies in the hinge members 53, 54. As in the first and second embodiments, the hinge members have resilient portions 53A, 54A and a relatively rigid portions 53B, 54B. The relatively rigid portions 53B, 54B include longer straight and shorter angled portions to effect a tight seal with the jamb 12 when the hinge members 53, 54 are deflected. Hinge member 54 is shown in the deflected position in FIG. 5, whereas hinge member 53 is shown in its normal or undeflected position. It will further be noted that the hinge members 53, 54 project downwardly and outwardly from the guide ways 42, 43 to which they are directed, and the relatively rigid portions 53B, 54B thus engage the jamb 12 immediately adjacent the edge members 51, 52, respectively.

Figure 6:
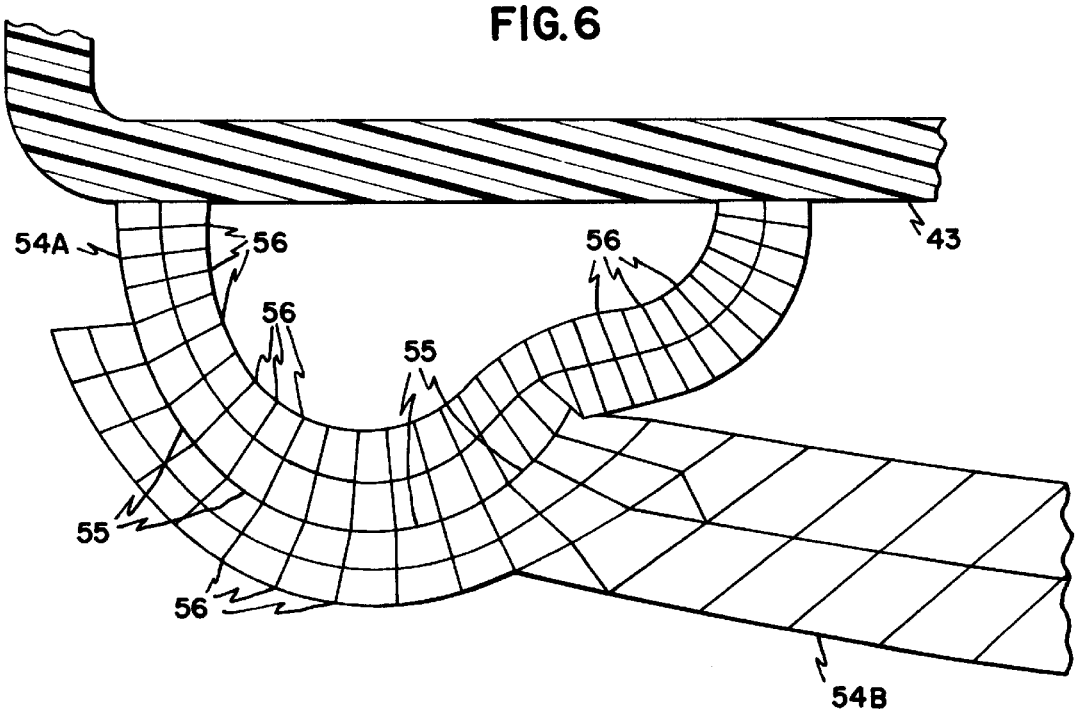
FIG. 6 is a further enlarged fragmentary sectional view of the third embodiment of the inventive jamb liner, including node lines from finite element analysis.

The resilient portions 53A, 54A are coextruded along the back inner corner edge of the guide ways 42, 43. The resilient portions 53A, 54A may be formed from any of a wide variety of resilient thermoplastic materials which resist creep, with the exception of polyvinylchloride, which has much less resistance to creep. With additional reference to FIG. 6, which is exemplary of both resilient portions, the resilient portion 54A is shown to define a closed tube normally of semi-circular configuration with the guide way 43 with which it is coextruded. With specific reference to FIG. 6, the relatively rigid leg 54B, which preferably is formed from PVC, is coextruded with the resilient portion 54A to merge along a common arcuate line 55, and the parts are relatively disposed so that, when the leg 54 is deflected upon engagement with the associated jamb, it causes a partial collapse of the resilient portion 54A as shown. As a result, resilient portion 54A is substantially in compression when the leg 54 is deflected. This is shown in FIG. 6 by mesh lines 56, which are computer generated in finite element analysis. It has been found that, when the resilient portions of the hinge members are placed in compression rather than in tension, the problem of creep in the resilient portion is decreased significantly over a substantial period of time as well over as a range of temperatures.

Based on the foregoing, it will be appreciated that it is not the semi-circular, tubular configuration that in and of itself resists creep, but rather the configuration of the resilient portions 53A, 54A and the configuration and relative position of the leg portions 53B, 54B in the arcuate region 55 of coextrusion that result in compressive rather than tensile forces when the hinge members 53, 54 are deflected. These primarily compressive forces mean that the spring member 54A is capable of generating substantially the same amount of spring force to the sash over a long period of time.

It has also been found that the resilient portions 53A, 53B impart a substantially constant force on the associated jamb sides over a range of deflections of a leg portions 54A, 54B. This is highly advantageous because the forces imparted by the jamb liners on the associated sashes are therefore also substantially constant, and the sliding movement of the sashes is therefore more uniform. The hinge members 53, 54 can therefore be designed to produce a substantially constant force of desired magnitude to accomplish optimum sliding of the sashes even with dimensional variations in the components as well as over a broad range of temperatures.

Figure 7:
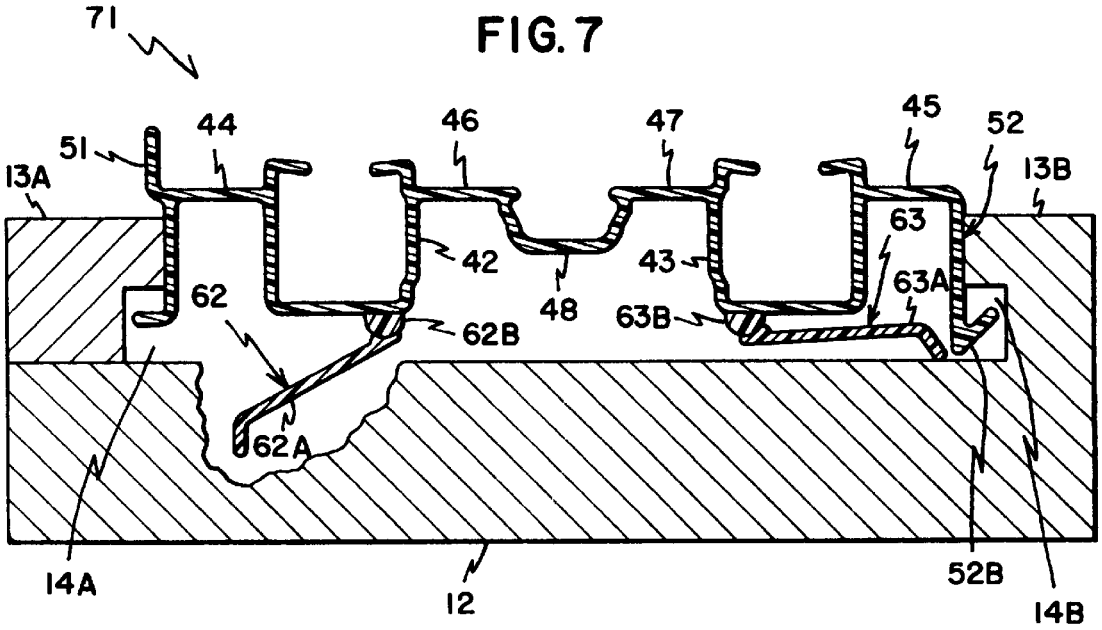
FIG. 7 is an enlarged transverse sectional view of a fourth embodiment of the inventive jamb liner.

Other configurations are possible that result in compressive rather than tensile forces when the jamb liner engages the jamb. With reference to FIG. 7, a fourth embodiment of the jamb liner is represented generally by the numeral 61. This embodiment is structurally similar to the jamb liner 41, and the same reference numerals are used to identify the same components. Jamb liner 61 has hinge members 62, 63 with relatively rigid portions 62A, 63A that are identical to its counterparts. However, the resilient portions 62B, 63B are in the form of a solid bead of resilience material rather than hollow. The resilient portions 62B, 63B collapse in much the same manner as the hollow resilient portions 53A, 54A (as shown in FIG. 6), resulting principally in compressive forces and hence resisting the incidence of creep in these resilient portions.

It will be appreciated that the inventive spring can be used for applications other than for biasing a jamb liner. The two spring portions may be used alone to define a spring member, or in combination with a base member, an example of which is the jamb liner body.

What is claimed is:

1. A spring member bendably disposable between first and second members to create a spring force therebetween, comprising:

a base member engageable by said first member;

a first spring portion formed from a first thermoplastic material that is resilient and has a predetermined spring characteristic, the first spring portion being integrally formed with said base member and being tubular in transverse cross-section;

a second spring portion integrally formed with and extending from the first spring portion and formed from a second thermoplastic material that has a spring characteristic stiffer than that of the first spring portion, the second spring portion being engageable by said second member; and the first and second spring portions being constructed and arranged so that the second spring portion is engageable by the second member and bendable thereby due to the resilience of the first spring portion to produce a desired spring force between the first and second members, and being further constructed and arranged so that the first spring portion is substantially under compressive loading when the second spring portion is bendably engaged by said second member.

2. The spring member defined by claim 1, wherein the base member is formed from plastic material.

3. The spring number defined by claim 1, wherein said base member and said first and second spring portions are elongated and said spring force is produced over the length of said first and second members.

4. The spring member defined by claim 3, wherein said second spring portion substantially comprises a flat strip of material.

5. The spring member defined by claim 4, wherein the first and second spring portions together define a single, substantially flat strip that projects angularly from said base member in cantilever fashion.

6. The spring member defined by claim 3, wherein the material of said base member and said second spring portion is polyvinylchloride, and the material of said first spring portion is an elastomeric material or blend of elastomeric materials capable of being coextruded with polyvinylchloride.

7. The spring member defined by claim 1, wherein the second plastic material is at least semi-rigid.

8. The spring member defined by claim 1, wherein said first plastic material is an elastomeric material or blend of elastomeric materials, and said second material is polyvinylchloride.

9. The spring member defined by claim 1, wherein said first spring portion comprises an enclosed tube of generally semi-circular configuration in an unstressed state.

10. A coextruded plastic spring member bendably disposable between the first and second members to create a spring force therebetween, comprising:

an elongated base member formed from a first plastic material engageable by said first member;

an elongated first spring portion formed from a second plastic material that is resilient and has a predetermined spring characteristic, the first spring portion being coextruded with said base member and being tubular in configuration;

an elongated second spring portion coextruded with and extending from said first spring portion and formed from a third plastic material that has a spring characteristic stiffer than that of the first spring portion, the second spring portion being engageable by said second member;

the first and second spring portions being constructed and arranged so that the second spring portion is engageable by the second member and bendable thereby due to the resilience of the first spring portion, and further so that the first spring portion is substantially under compressive loading when the second spring portion is bendably engaged by said second member.

11. The spring member defined by claim 10, wherein the first spring portion comprises an enclosed tube of generally semi-circular configuration in an unstressed state.

12. A coextruded thermoplastic spring member bendably disposable between first and second members to create a spring force therebetween, comprising:

an elongated base member formed from a first thermoplastic material engageable by said first member;

an elongated first spring portion formed from a second thermoplastic material that is resilient and has a predetermined spring characteristic, the first spring portion being coextruded with said base member and being tubular in transverse cross-section;

an elongated second spring portion coextruded with and extending from said first spring portion and formed from a third thermoplastic material that has a spring characteristic stiffer than that of the first spring portion, the second spring portion being engageable by said second member; and the first and second spring portions being constructed and arranged so that the second spring portion is engageable by the second member and bendable thereby due to the resilience of the first spring portion and further so that the first spring portion is substantially under compressive loading when the second spring portion is bendably engaged by said second member.

13. The spring member defined by claim 12, wherein the second spring portion comprises a leg member that projects angularly with respect to said base member.

14. The spring member defined by claim 10, wherein the first and third plastic materials are the same.

15. The spring member defined by claim 12, wherein the first and third plastic materials are polyvinylchloride, and the second plastic material is an elastomeric material or blend of elastomeric materials capable of being coextruded with polyvinylchloride.

16. A spring member bendably disposable between first and second members to create a spring force therebetween, comprising:

a first spring portion formed from a first thermoplastic material that is resilient and has a predetermined spring characteristic, the first spring portion being engageable by said first member and being of tubular transverse cross-section;

a second spring portion integrally formed with and extending from the first spring portion and formed from a second thermoplastic material that has a spring characteristic stiffer than that of the first spring portion, the second spring portion being engageable by said second member; and the first and second spring portions being constructed and arranged so that the second spring portion is engageable by the second member and bendable thereby due to the resilience of the first spring portion to produce a desired spring force between the first and second members, and further constructed and arranged so that the first spring portion is substantially under compressive loading when the second spring portion is bendably engaged by said second member.

17. The spring member defined by claim 16, wherein said enclosed tube is of generally semi-circular configuration in an unstressed state.

18. The spring member defined by claim 16, wherein the second plastic material is at least semi-rigid.

19. The spring member defined by claim 16, wherein the first thermoplastic material is an elastic material or blend of elastic materials, and the second thermoplastic material is polyvinylchloride.

20. The spring member defined by claim 16, wherein said first and second spring portions are elongated.

21. A spring member bendably disposable between first and second members to create a spring force therebetween, comprising:

a base member engageable by said first member;

a first spring portion formed from a first thermoplastic material that is resilient and has a predetermined spring characteristic, the first spring portion being integrally formed with said base member and comprising a solid bead of said first thermoplastic material;

a second spring portion integrally formed with and extending from the first spring portion and formed from a second thermoplastic material that has a spring characteristic stiffer than that of the first spring portion, the second spring portion being engageable by said second member; and the first and second spring portions being constructed and arranged so that the second spring portion is engageable by the second member and bendable thereby due to the resilience of the first spring portion to produce a desired spring force between the first and second members, and being further constructed and arranged so that the first spring portion is substantially under compressive loading when the second spring portion is bendably engaged by said second member.

22. The spring member defined by claim 21, wherein said solid bead of material is of generally semi-circular transverse cross-section in an unstressed state.

23. The spring member defined by claim 21, wherein the base member and first and second spring portions are elongated.

24. A spring member bendably disposable between first and second members to create a spring force therebetween, comprising:

a base member engageable by said first member;

a first spring portion formed from a first thermoplastic material that is resilient and has a predetermined spring characteristic, the first spring portion being integrally formed with said base member;

a second spring portion integrally formed with and extending from the first spring portion and formed from a second thermoplastic material that has a spring characteristic stiffer than that of the first spring portion, at least a part of said second spring portion extending from the first spring portion at an acute angle relative to the base member and being laterally engageable by said second member;

the first and second spring portions being constructed and arranged so that the second spring portion is laterally engageable by the second member and deflectable thereby due to the resilience of the first spring portion to produce a desired spring force between the first and second members.

25. The spring member defined by claim 24, wherein the first spring portion is tubular in transverse cross-section.

26. The spring member defined by claim 24, wherein the first spring portion comprises a solid bead of said first thermoplastic material.

* * * * *